US009074496B2

(12) United States Patent
Schuler

(10) Patent No.: US 9,074,496 B2
(45) Date of Patent: Jul. 7, 2015

(54) ELECTROMAGNETIC ACTUATING DEVICE

(75) Inventor: Friedrich Schuler, Wilhelmsdorf (DE)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 119 days.

(21) Appl. No.: 13/989,716

(22) PCT Filed: Sep. 15, 2011

(86) PCT No.: PCT/EP2011/065983

§ 371 (c)(1),
(2), (4) Date: May 24, 2013

(87) PCT Pub. No.: WO2012/072291

PCT Pub. Date: Jun. 7, 2012

(65) Prior Publication Data

US 2013/0255607 A1 Oct. 3, 2013

(30) Foreign Application Priority Data

Nov. 29, 2010 (DE) ..... 10 2010 052 841

(51) Int. Cl.

| | |
|---|---|
| ***F01L 9/04*** | (2006.01) |
| ***F01L 1/34*** | (2006.01) |
| ***F01L 13/00*** | (2006.01) |
| *F01L 25/08* | (2006.01) |

(52) U.S. Cl.
CPC .... *F01L 1/34* (2013.01); *F01L 9/04* (2013.01); *F01L 25/08* (2013.01); *F01L 2009/0423* (2013.01); *F01L 13/0036* (2013.01)

(58) Field of Classification Search
CPC ..... F01L 9/04; F01L 25/08; F01L 2009/0423; F01L 1/34; F01L 13/0036
USPC ..... 123/90.16, 90.18, 90.11; 251/129.01, 251/129.15
See application file for complete search history.

(56) References Cited

U.S. PATENT DOCUMENTS

| | | | | |
|---|---|---|---|---|
| 7,426,912 | B2 | 9/2008 | Lee | |
| 8,339,225 | B2 * | 12/2012 | Nendel | 335/229 |
| 8,851,035 | B2 * | 10/2014 | Gunnel | 123/90.18 |
| 2004/0041114 | A1 * | 3/2004 | Hirata et al. | 251/129.15 |
| 2004/0201441 | A1 * | 10/2004 | Elendt et al. | 335/179 |
| 2007/0290581 | A1 * | 12/2007 | Burnett et al. | 310/49 R |

(Continued)

FOREIGN PATENT DOCUMENTS

| | | | |
|---|---|---|---|
| DE | 102006051809 | A1 | 5/2008 |
| DE | 102006059188 | A1 | 6/2008 |

(Continued)

*Primary Examiner* — Ching Chang
(74) *Attorney, Agent, or Firm* — Davidson, Davidson & Kappel, LLC

(57) ABSTRACT

An electromagnetic actuating device is being proposed for a valve train that can be adjusted on the cam side in an internal combustion engine, including a housing with a top part and a bottom part, whereby an electrically energizable solenoid device is embedded in the top part of the housing and an adjusting pin that is actuated by the solenoid device is mounted in the bottom part of the housing so as to move longitudinally, and also including a plug-in connector that is made of plastic and that runs on the top part of the housing in order to supply electricity to the solenoid device as well as a connecting flange that runs on the housing in order to attach the actuating device to the internal combustion engine. The plug-in connector and the connecting flange are integral parts of the top part of the housing made by encapsulating the solenoid device with plastic.

3 Claims, 3 Drawing Sheets

(56) References Cited

U.S. PATENT DOCUMENTS

| | | | | |
|---|---|---|---|---|
| 2010/0126448 | A1* | 5/2010 | Talan et al. | 123/90.17 |
| 2010/0251982 | A1* | 10/2010 | Elendt et al. | 123/90.18 |
| 2012/0235777 | A1* | 9/2012 | Elendt et al. | 335/229 |
| 2013/0000581 | A1* | 1/2013 | Popp et al. | 123/90.18 |

FOREIGN PATENT DOCUMENTS

| | | | |
|---|---|---|---|
| DE | 102007002430 | A1 | 6/2008 |
| DE | 102007040677 | A1 | 3/2009 |
| DE | 102008020892 | A1 | 10/2009 |
| DE | 102008020893 | A1 | 10/2009 |
| DE | 202009015468 | U1 | 2/2010 |
| DE | 202009015466 | U1 | 3/2010 |
| DE | 102009015486 | A1 | 9/2010 |
| DE | 102010013216 | A1 | 10/2010 |
| EP | 0798451 | B1 | 4/1999 |
| WO | WO 2010097298 | A1 * | 9/2010 |

* cited by examiner

ELECTROMAGNETIC ACTUATING DEVICE

The invention relates to an electromagnetic actuating device for a valve train that can be adjusted on the cam side in an internal combustion engine, comprising a housing with a top part and a bottom part, whereby an electrically energizable solenoid device is embedded in the top part of the housing and an adjusting pin that is actuated by the solenoid device is mounted in the bottom part of the housing so as to move longitudinally, and also comprising a plug-in connector that is made of plastic and that runs on the top part of the housing in order to supply electricity to the solenoid device as well as a connecting flange that runs on the housing in order to attach the actuating device to the internal combustion engine.

BACKGROUND OF THE INVENTION

The phase "valve trains that can be adjusted on the cam side" as set forth in the present invention relates to those valve trains that generate the stroke variability on the charge-exchange valve by means of axially movable cam pieces. They are provided with cam groups whose different cam elevations—depending on the axial cam position—selectively engage with a rigid cam follower. In order to axially adjust the cam piece, normally a stationary actuating device that is supported in the internal combustion engine is provided with one (or more) adjusting pin(s) that is/are coupled into a spiral groove-shaped axial link on the rotating cam piece and can cause the cam piece to move around the axial stroke of the spiral groove. The mode of operation relating to this is elaborated upon in detail in European patent EP 0 798 451 B1.

An actuating device of the above-mentioned type is disclosed in German patent application DE 10 2006 059 188 A1. The solenoid device comprises a plastic coil element onto which the plug-in connector made of plastic has been injection-molded.

SUMMARY OF THE INVENTION

It is an object of the present invention to provide a construction of an actuating device of the above-mentioned type with an eye towards minimizing the production costs.

The present invention provides that the plug-in connector and the connecting flange should be integral parts of the top part of the housing made by encapsulating the solenoid device with plastic. In other words, the functions of the plug-in connector, the connecting flange and the top part of the housing are integrated into a single plastic element, whereby the envisaged cost advantage is additionally achieved in that the normally provided enclosure of the top part of the housing in a metal sleeve can be eliminated.

An end section of the top part of the housing facing the bottom part of the housing can be provided with a ring collar whose inner circumferential surface is formed by a metal sleeve encapsulated with plastic and attached to the outer circumferential surface of an end section of the bottom part of the housing facing the top part of the housing. The attachment can be in the form of a non-positive fit in that the outer circumferential surface of the bottom part of the housing is pressed into the metal sleeve, or else this can be done by means of a positive fit in that, for instance, the metal sleeve is radially flanged and catches behind a shoulder of the bottom part of the housing.

Regarding the requisite sealing of the actuating device mounted on the internal combustion engine, it may be provided that the end face of the ring collar of the top part of the housing is provided with a circumferential groove that runs radially outside of the metal sleeve, whereby an elastic axial gasket is inserted into said groove.

The function integration according to the invention and the associated advantages in terms of costs and installation space are particularly advantageous if (as in fundamentally known from German patent application DE 10 2007 040 677 A1) the actuating device has several solenoid devices and adjusting pins that are each actuated by one of the solenoid devices. With such a multifunctional actuating device, each solenoid device and the adjusting pin actuated by it are all located on a shared axis that runs at a parallel distance or skewed with respect to the axis of another solenoid device and of another associated adjusting pin.

As an alternative, it can be provided that the axes of the solenoid devices run at a parallel distance from each other, whereas the axes of the adjusting pins are likewise at a parallel distance or skewed with respect to each other, but run at an angle with respect to the axes of the solenoid devices.

BRIEF DESCRIPTION OF THE DRAWINGS

Additional features of the invention ensue from the description below and from the drawings depicting embodiments of the invention. Unless otherwise indicated, identical or functionally identical features or components are designated by the same reference numerals. The figures show the following.

DETAILED DESCRIPTION

Figure 2:
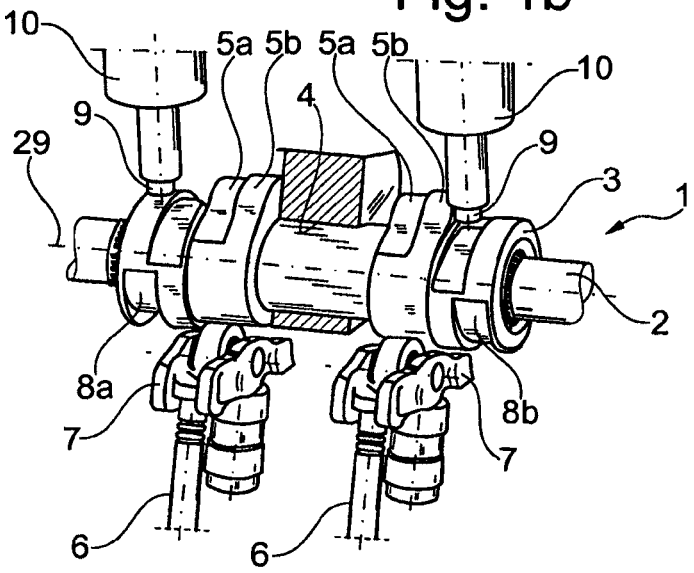
FIG. 2 a prior-art valve train with two single actuating devices and two axial links, each having a spiral groove.

The invention is being explained on the basis of FIG. 2, which shows the mechanical mode of action of a prior-art stroke-variable valve train of an internal combustion engine with movable cam pieces. The valve train comprises a camshaft 1 having a support shaft 2 with lengthwise external toothing and cam pieces 3 which, by means of corresponding lengthwise internal toothing, are arranged on said support shaft 2 so that it is non-rotatable and can be moved lengthwise between two axial positions, whereby only one cam piece 3 is shown here. The cam piece 3, which is mounted in the center of a camshaft point of support 4 of the internal combustion engine, has two cam groups of directly adjacent cams 5*a* and 5*b* having different elevations that, by means of rockers 7, serve to actuate charge-exchange valves 6 as a function of the operating point. The movement of the cam piece 3 on the support shaft 2, which is necessary in order to selectively activate the individual cam 5*a* or 5*b*, is carried out by means of two axial links in the form of spiral grooves 8*a* and 8*b* that run on the ends of the cam piece 3 and differ in their orientation as a function of the direction of movement, and into which, depending on the momentary axial position of the cam piece 3, each outer end of the adjusting pins 9 can be radially coupled into electromagnetic actuating devices 10 held rigidly in the internal combustion engine in order to move the cam piece 3.

The spiral grooves 8*a*, 8*b* extend not only in the axial direction but also in the radial direction in such a way that, towards the end of the moving procedure, radially ascending ejection ramps cause the adjusting pins 9 to be uncoupled from the spiral grooves 8*a*, 8*b* and to be brought into their disengaged resting position in the actuating devices 10.

Figure 1A:
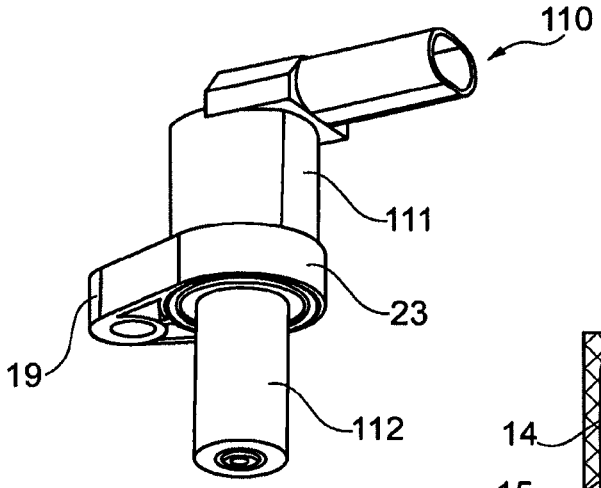
FIG. 1*a* a single actuating device in a perspective view.
Figure 1B:
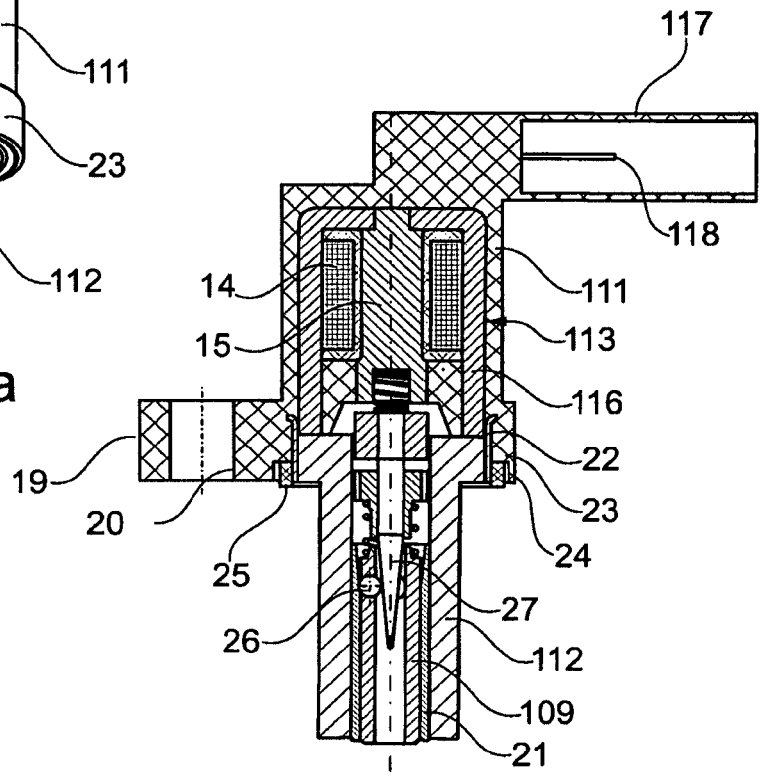
FIG. 1*b* the single actuating device in a longitudinal section through the axis of the adjusting pin.

A first embodiment of an actuating device 110 according to the invention is disclosed in FIGS. 1*a* and 1*b*. The actuating device 110 comprises a housing consisting of a top part 111 and a bottom part 112. An electrically energizable solenoid device 113 is embedded in the top part 111 of the housing and its essential components are a solenoid 14, a magnetic core 15 contained therein and a U-shaped metal bracket 116 in order to form a magnetic return. The electricity is supplied to the solenoid 14 via a plug-in connector 117 whose contact pins (pin 118 is visible) are electrically connected to the solenoid 14. The actuating device 110 is fastened in a receptacle of the internal combustion engine by means of a connecting flange 19 that runs in the top part 111 of the housing and that has a fastening hole 20 for a screw (not shown here). The plug-in connector 117 and the connecting flange 19 are integral parts of the top part 111 of the housing created by encapsulating the solenoid device 113 with plastic. If necessary, the fastening hole 20 can also be reinforced with an encapsulated metal sleeve (not shown here). Suitable plastics for the top part 111 of the housing are especially fiberglass-reinforced polyamide (abbreviated PA-GF) or high temperature-resistant polyphenylene sulfide (abbreviated PPS).

The bottom part 112 of the housing is lined with a thin-walled steel bushing 21 in which an adjusting pin 109 actuated by the solenoid device 113 is mounted so as to move in the lengthwise direction. The end of the pin is momentarily located in its retracted resting position in the bottom part 112 of the housing, that is to say, in the mounted state of the actuating device 110, it is disengaged from its spiral groove 8, as shown in FIG. 2. As an alternative, the bottom part 112 of the housing, which is made of steel material, can also be configured as a plastic injection-molded part in which, if necessary, functional surfaces that are more highly stressed can be made of encapsulated steel parts.

The top part 111 of the housing and the bottom part 112 of the housing are fastened to each other by means of a press fit between the inner circumferential surface of a metal sleeve 22 in the top part 111 of the housing and the outer circumferential surface of an end section of the bottom part 112 of the housing facing the top part 111 of the housing. The likewise plastic-encapsulated metal sleeve 22 is part of a ring collar 23 on an end section of the top part 111 of the housing facing the bottom part 112 of the housing. The end face of the ring collar 23 has a circumferential groove 24 which runs radially outside of the metal sleeve 22 and into which an elastic axial gasket 25, here in the form of an elastomeric ring with a rectangular cross section, has been inserted in order to fasten the actuating device 110 in a receptacle of the internal combustion engine so that said actuating device 110 is sealed off.

The construction of the actuating devices shown in FIGS. 1, 3 and 4 for actuating the adjusting pin(s) is fundamentally known—see, for example, German patent application DE 10 2008 020 892 A1—so that this is only mentioned here in passing. By means of a clamping effect relative to the steel bushing 21 and a spherical locking pin 27, the hollow-cylindrical adjusting pin 109 is held in its retracted resting position by a ball detent mechanism having three balls 26 circumferentially distributed along the wall of the adjusting pin 109. The adjusting pin 109, which is spring-loaded in the extending direction, can be extended by energizing the solenoid device 113 that runs coaxially to the adjusting pin 109 and to the locking pin 27, and said solenoid device 113 then magnetically attracts the locking pin 27 opposite to the extending direction of the adjusting pin 109, thus cancelling out the clamping effect of the balls 26. Subsequently, the adjusting pin 109 extends from the bottom part 112 of the housing into its working position in which the adjusting pin 109 is coupled into the associated spiral groove 8, as shown in FIG. 2. The retraction of the adjusting pin 109 into its resting position, which is necessary after the cam piece has been moved, is caused by the above-mentioned profile on the spiral groove 8 with the radially ascending ejection ramp in its end area, whereby the adjusting pin 109 latches with the ball detent mechanism in the position shown when the solenoid 14 has been de-energized.

Figure 3A:
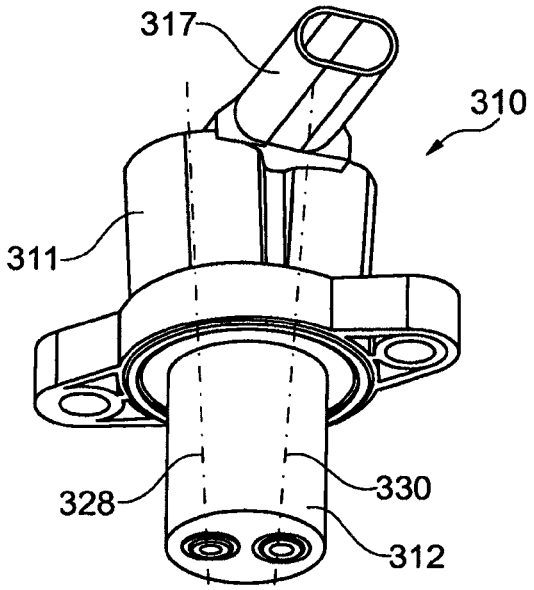
FIG. 3*a* a double actuating device in a perspective view.
Figure 3B:
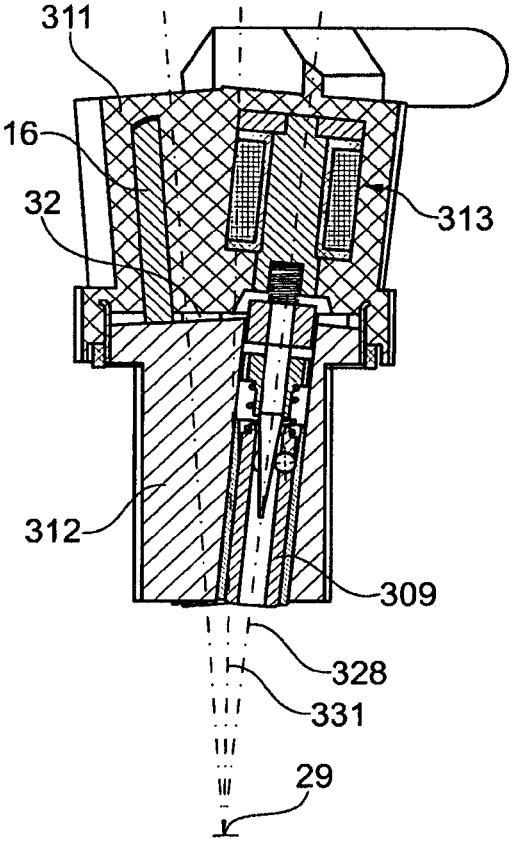
FIG. 3*b* the double actuating device in a longitudinal section through the first adjusting pin axis.
Figure 3C:
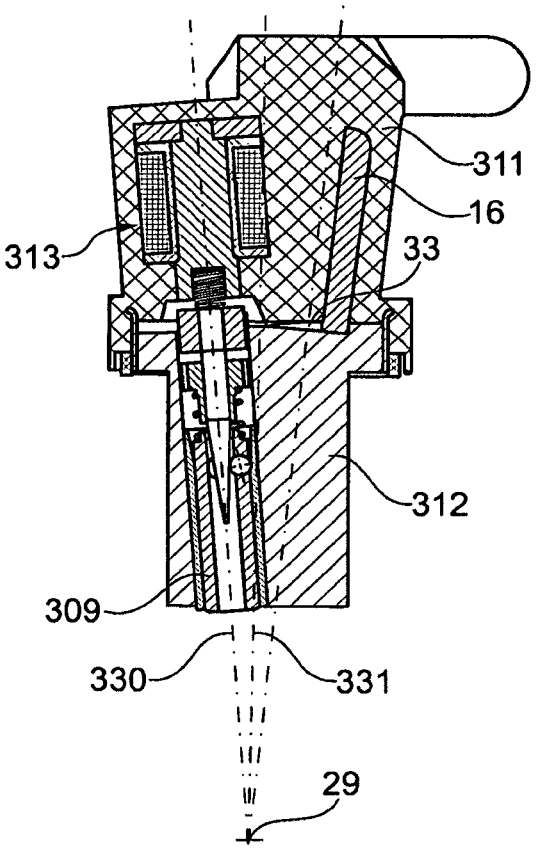
FIG. 3*c* the double actuating device in a longitudinal section through the second adjusting pin axis.
Figure 4A:
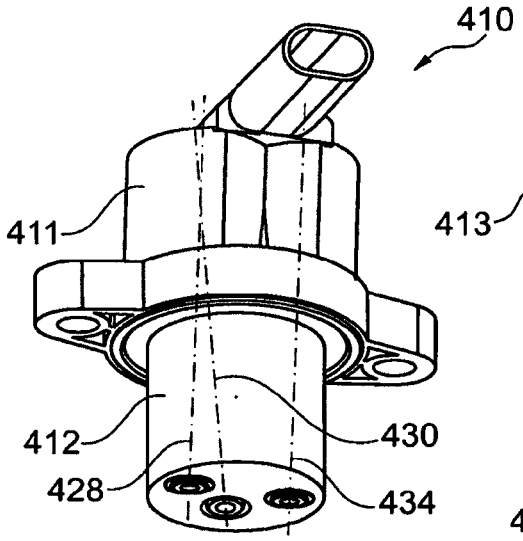
FIG. 4*a* a triple actuating device in a perspective view.
Figure 4B:
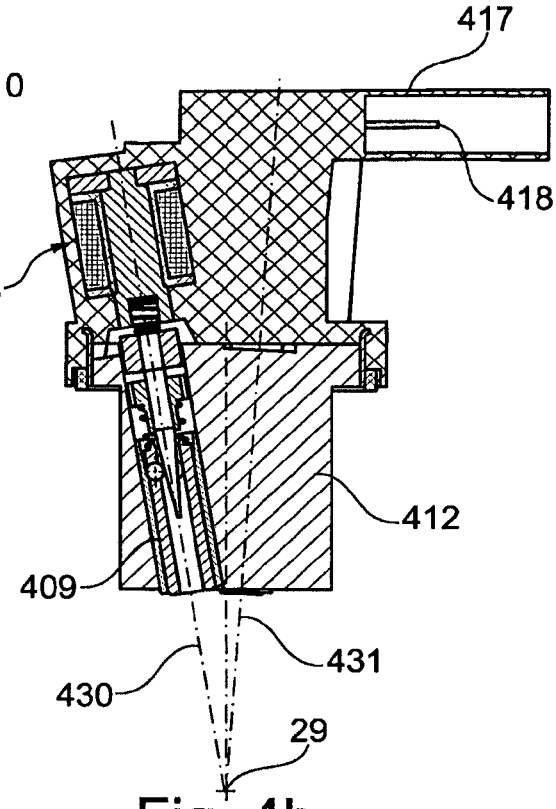
FIG. 4*b* the triple actuating device in a longitudinal section through the first adjusting pin axis.
Figure 4C:
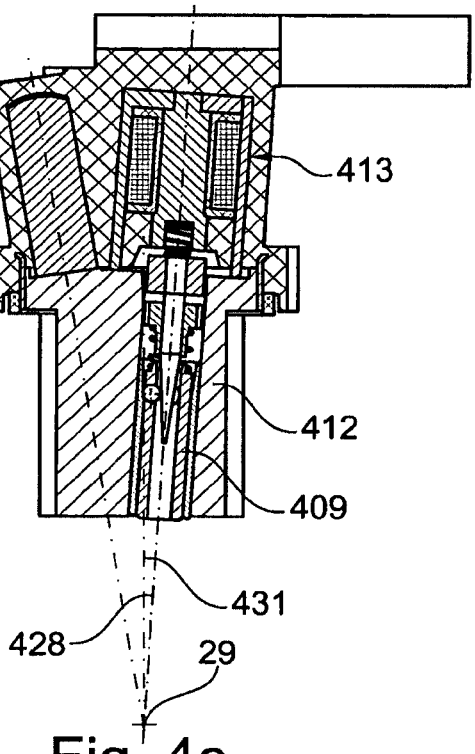
FIG. 4*c* the triple actuating device in a longitudinal section through the second adjusting pin axis.
Figure 4D:
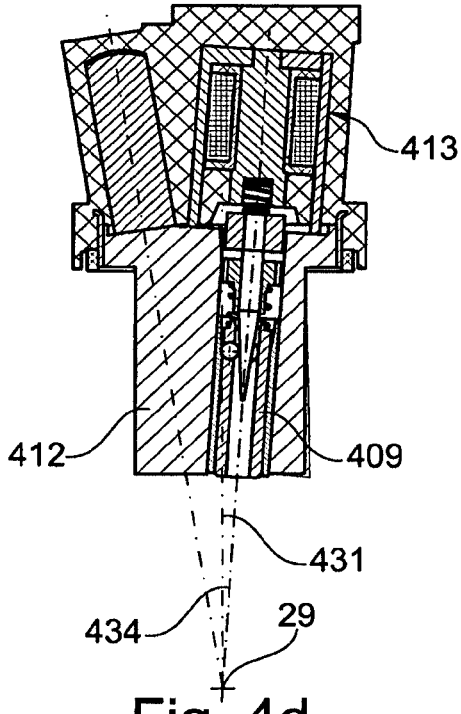
FIG. 4*d* the triple actuating device in a longitudinal section through the third adjusting pin axis.

The second embodiment of an actuating device 310 according to the invention shown in FIGS. 3*a* to 3*c* essentially has the following differences in comparison to the first embodiment. The actuating device 310 comprises two solenoid devices 313 arranged in a shared top part 311 of the housing, detent elements and associated adjusting pins 309. The radially particularly compact structure of the actuating device 310 is achieved in that the solenoid devices 313 and consequently the adjusting pins 309 are arranged so as to be skewed with respect to each other. This can be seen in the two longitudinal sections: FIG. 3*b* shows a section along the adjusting pin axis 328 and perpendicular to the camshaft axis 29 (also see FIG. 2), while FIG. 3*c* shows a section along the adjusting pin axis 330, likewise perpendicular to the camshaft axis 29. In this context, the adjusting pin axes 328 and 330, which are at a distance from each other in the camshaft axis direction and which intersect the camshaft axis 29, are slanted in opposite directions with respect to the longitudinal axis 331 of the bottom part 312 of the housing. In order to create a flat contact surface for the correspondingly slanted metal bracket 316 on the bottom part 312 of the housing, its end face is provided with appropriately slanted pockets 32, 33. The two solenoid devices 313 can be actuated independently of each other due to the number of contact pins (not visible here) in the plug-in connector 317.

The third embodiment of an actuating device 410 according to the invention shown in FIGS. 4*a* to 4*d* essentially has the following differences in comparison to the second embodiment. The actuating device 410 comprises three solenoid devices 413 arranged in a shared top part 411 of the housing, detent elements and associated adjusting pins 409. The radially compact structure of the actuating device 410 is likewise achieved in that the directly adjacent solenoid devices 413 and the associated adjusting pins 409 are slanted in opposite directions with respect to the longitudinal axis 431 of the bottom part 412 of the housing. In this context, the adjusting pins 409 that are on the outside in the direction of the camshaft axis 29 run parallel to each other and skewed with respect to the center adjusting pin 409 in the direction of the camshaft axis, whereby the axis 430 of the adjusting pin 409 is also at a relatively large angle of inclination relative to the longitudinal axis 431 of the bottom part 412 of the housing. In this case as well, all three adjusting pin axes 428, 430 and 434 intersect the camshaft axis 29. The three solenoid devices 413 can be actuated independently of each other due to the number of contact pins (not visible here) in the plug-in connector 417.

REFERENCE NUMERALS

1 camshaft
2 support shaft
3 cam piece
4 camshaft point of support
5 cam
6 charge-exchange valve
7 rocker
8 spiral groove
9 adjusting pin
10 actuating device
11 top part of the housing
12 bottom part of the housing
13 solenoid device
14 solenoid
15 magnetic core
16 metal bracket
17 plug-in connector
18 contact pin
19 connecting flange
20 fastening hole
21 steel bushing
22 metal sleeve
23 ring collar
24 circumferential groove
25 axial gasket
26 ball
27 locking pin
28 adjusting pin axis
29 camshaft axis
30 adjusting pin axis
31 longitudinal axis of the bottom part of the housing
32 pocket
33 pocket
34 adjusting pin axis

The invention claimed is:

1. An electromagnetic actuating device for a valve train that can be adjusted on a cam side in an internal combustion engine, comprising:

a housing with a top part and a bottom part;

an electrically energizable solenoid device embedded in the top part;

an adjusting pin actuated by the electrically energizable solenoid device and mounted in the bottom part so as to move longitudinally;

a plug-in connector made of plastic and on the top part to supply electricity to the electrically energizable solenoid device;

a connecting flange on a housing to attach the electromagnetic actuating device to the internal combustion engine, the plug-in connector and the connecting flange being integral parts of the top part made by encapsulating the electrically energizable solenoid device with plastic, wherein an end section of the top part facing the bottom part has a ring collar whose inner circumferential surface is formed by a metal sleeve encapsulated with the plastic and attached to an outer circumferential surface of an end section of the bottom part facing the top part.

2. The actuating device as recited in claim 1 wherein the ring collar has a circumferential groove running radially outside of the metal sleeve, and further comprising an elastic axial gasket is inserted into the circumferential groove.

3. The electromagnetic actuating device as recited in claim 1 wherein the electromagnetic actuating device includes at least one further solenoid device and at least one further adjusting pin actuated by the further solenoid device, the further solenoid device and the further adjusting pin located on a shared axis running at a parallel distance or skewed with respect to the axis of the electrically energizable solenoid device and the adjusting pin.

* * * * *